US008657724B2

(12) United States Patent
Yang

(10) Patent No.: US 8,657,724 B2
(45) Date of Patent: Feb. 25, 2014

(54) FOLDING TREADMILL

(75) Inventor: Shun-Chi Yang, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 580 days.

(21) Appl. No.: 12/972,682

(22) Filed: Dec. 20, 2010

(65) Prior Publication Data

US 2012/0071299 A1 Mar. 22, 2012

(30) Foreign Application Priority Data

Sep. 20, 2010 (TW) ..... 99218183 U

(51) Int. Cl.
*A63B 21/00* (2006.01)

(52) U.S. Cl.
USPC ..... 482/54; 482/74; 482/70

(58) Field of Classification Search
USPC ..... 482/54, 52, 56, 51, 74, 71, 57
See application file for complete search history.

(56) References Cited

U.S. PATENT DOCUMENTS

| | | | |
|---|---|---|---|
| 5,674,156 | A | 10/1997 | Watterson et al. |
| 5,674,453 | A | 10/1997 | Watterson et al. |
| 5,704,879 | A | 1/1998 | Watterson et al. |
| 5,733,228 | A | 3/1998 | Stevens |
| 5,772,560 | A | 6/1998 | Watterson et al. |
| 5,816,981 | A | 10/1998 | Hung |
| 6,090,016 | A | 7/2000 | Kuo |
| 6,110,077 | A | 8/2000 | Yu |
| 6,213,919 | B1 | 4/2001 | Wang et al. |
| 6,579,211 | B2 | 6/2003 | Wu |
| 6,602,167 | B2 | 8/2003 | Chen |
| 6,682,460 | B2 | 1/2004 | Lo et al. |
| 6,685,599 | B2 | 2/2004 | Wang et al. |
| 6,746,374 | B2 | 6/2004 | Chang |
| 6,758,791 | B1 | 7/2004 | Kuo |
| 6,913,562 | B2 | 7/2005 | Chen |
| 6,974,404 | B1 | 12/2005 | Watterson et al. |
| 7,081,069 | B2 | 7/2006 | Hsu |
| 7,097,594 | B2 | 8/2006 | Lo |
| 7,104,930 | B2 | 9/2006 | Lo et al. |
| 7,166,065 | B2 | 1/2007 | Chang |
| 7,211,029 | B2 | 5/2007 | Kau |
| 7,381,160 | B2 | 6/2008 | Lo |
| 7,540,829 | B1 | 6/2009 | Chen |
| 7,569,000 | B2 | 8/2009 | Wang |
| 7,585,255 | B1 | 9/2009 | Chen |
| 2002/0142892 | A1 | 10/2002 | Chen et al. |
| 2002/0147078 | A1 | 10/2002 | Wu |
| 2004/0132584 | A1* | 7/2004 | Chen ..... 482/54 |
| 2004/0176216 | A1 | 9/2004 | Yu |
| 2004/0220020 | A1 | 11/2004 | Wang et al. |

(Continued)

FOREIGN PATENT DOCUMENTS

| | | | |
|---|---|---|---|
| GB | 23987514 | A | 8/2004 |

*Primary Examiner* — Jerome W Donnelly
(74) *Attorney, Agent, or Firm* — Bacon & Thomas, PLLC

(57) ABSTRACT

A folding treadmill includes a base frame, a running platform having a first end thereof pivotally connected to the base frame, a lifting mechanism mounted to one end of the base frame and to the first end of the running platform for lifting the associated first end of the running platform relative to the base frame A damping device is mounted to the base frame, and a folding mechanism having a lift cylinder is installed in the running platform and a link is pivotally connected between the lift cylinder and the damping device.

10 Claims, 8 Drawing Sheets

(56) References Cited

U.S. PATENT DOCUMENTS

| | | | | |
|---|---|---|---|---|
| 2005/0164840 | A1 | 7/2005 | Chen | |
| 2006/0003869 | A1 | 1/2006 | Huang et al. | |
| 2006/0040798 | A1 | 2/2006 | Weier et al. | |
| 2006/0058160 | A1 * | 3/2006 | Lee et al. | 482/54 |
| 2006/0122037 | A1 | 6/2006 | Chou Lin | |
| 2006/0122038 | A1 | 6/2006 | Chou Lin | |
| 2006/0240951 | A1 | 10/2006 | Wang | |
| 2007/0004561 | A1 * | 1/2007 | Yoo | 482/54 |
| 2007/0049464 | A1 | 3/2007 | Chou | |
| 2007/0054780 | A1 | 3/2007 | Trevino et al. | |
| 2007/0191190 | A1 | 8/2007 | Kuo | |
| 2008/0182726 | A1 | 7/2008 | Wu | |
| 2008/0188358 | A1 * | 8/2008 | Kuo | 482/54 |
| 2008/0312046 | A1 | 12/2008 | Lin et al. | |
| 2009/0005224 | A1 | 1/2009 | Davis et al. | |
| 2009/0042698 | A1 | 2/2009 | Wang | |
| 2009/0069159 | A1 | 3/2009 | Wang | |
| 2009/0093347 | A1 | 4/2009 | Wang | |
| 2009/0111664 | A1 | 4/2009 | Kau | |
| 2009/0111665 | A1 | 4/2009 | Wang | |
| 2009/0124465 | A1 | 5/2009 | Wang | |
| 2009/0124466 | A1 * | 5/2009 | Zhang | 482/54 |
| 2009/0163327 | A1 | 6/2009 | Huang et al. | |
| 2009/0239716 | A1 | 9/2009 | Wang | |
| 2010/0029444 | A1 | 2/2010 | Lo | |
| 2010/0056344 | A1 | 3/2010 | Chu | |

* cited by examiner

FOLDING TREADMILL

This application claims, under 35 U.S.C. §119, priority to Taiwanese Application No. 099218183, filed Sep. 20, 2010, which application is hereby incorporated by reference herein in its entirety, inclusive of the specification, claims, and drawings.

FIELD OF THE INVENTION

The present disclosure relates to treadmills and more particularly, to a folding treadmill, which allows tilting of the running platform.

BACKGROUND

Modern people are commonly busy at work and have less time and opportunity for exercise. Therefore, people may use different exercising apparatus at home for exercise. The treadmill is one of the most popularly accepted exercising machines for commercial and home use.

A commercial treadmill, in addition to a folding function to save storage space, may provide a running platform lifting function so that the user can adjust the running platform to a tilted position for simulating running on a hill. However, when the running platform is lifted, vibration of the motor used to lift the running platform may lead to instability of the running platform. Additionally, frequent lifting and lowering of the running platform may cause an overload of the lifting motor and friction damage to the other components of the treadmill used to achieve the lifting of the running platform.

Therefore, a treadmill that provides a running platform lifting function must use a high power motor to avoid an overload. However, using a high power motor adds additional cost to the price of such a treadmill.

SUMMARY

The present disclosure has been accomplished under the circumstances in view. Therefore, embodiments of the present disclosure provide a folding treadmill with a liftable running platform so that the user, during the use of the folding treadmill, can stably lift the running platform to a tilted position for simulating running on a hill and, which has structure and mechanisms to avoid component damage or motor overload during lifting of the running platform.

To achieve this and other objects of the present disclosure, a folding treadmill includes a base frame, a running platform, a lifting mechanism, at least one damping device, and at least one folding mechanism. The running platform has one end thereof pivotally connected to the base frame. The lifting mechanism is installed at one end of the base frame and at one end of the running platform, and is adapted for lifting the associated end of the running platform relative to the base frame. The folding mechanism includes a lift cylinder and a link. The lift cylinder is mounted in or on the running platform. The link has one end thereof pivotally connected to the lift cylinder, and another opposed end thereof pivotally connected to the base frame, and in particular, pivotally connected to the damping device, which is connected to the base frame.

More specifically, the damping device includes a damping cylinder and a slide. The damping cylinder is mounted to or within the base frame. The slide has one end operatively connected to the damping cylinder and an opposed end thereof pivotally connected to the link for allowing relative movement of the link between the damping cylinder and the lift cylinder. Further, the slide is movable along the base frame.

The lifting mechanism includes at least one pivot rod, a motor, a screw rod, a screw nut, and at least one follower member. Each pivot rod has one end thereof pivotally connected to the running platform, and another opposed end thereof pivotally connected to the base frame. The motor is mounted to the running platform. The screw rod is connected to one end of the motor and is rotatable by the motor. The screw nut is threaded onto the screw rod, and is movable along the screw rod upon rotation of the screw rod. The at last one follower member has one end thereof connected to the screw nut and another end thereof connected to the at least one pivot rod.

In an exemplary embodiment, the treadmill can be provided with two pivot rods. In this case, the two pivot rods are respectively pivotally connected between two opposite lateral sides of the base frame and the two opposite sides of the running platform in order to stabilize lifting of the running platform. Similarly, the treadmill can be provided with two follower members. In this case, the two follower members are respectively fastened to two opposite sides of the screw nut.

The lifting mechanism may further include at least one transverse rod adapted for connecting the two pivot rods and for moving the at least one follower member. If two folding mechanisms are used, the two folding mechanisms are respectively pivotally connected between two opposite lateral sides of the base frame and two opposite lateral sides of the running platform. In this case, two damping devices can be used, and these two damping devices are respectively mounted on the two opposite lateral sides of the base frame and respectively connected to the two folding mechanisms.

Further, the lift cylinder of each folding mechanism can be a pneumatic cylinder. Similarly, the damping cylinder of each damping mechanism can also be a pneumatic cylinder.

Thus, when the lifting mechanism lifts the associated end of the running platform, the damping device absorbs the horizontal component of the lifting force, and the lifting mechanism simply applies a vertical pressure to the running platform to lift the running platform to a tilted position. Therefore, embodiments of treadmills according to the disclosure provide a mechanism to reduce the horizontal load of the motor, thus protecting from an overload of the motor.

DETAILED DESCRIPTION

Figure 1:
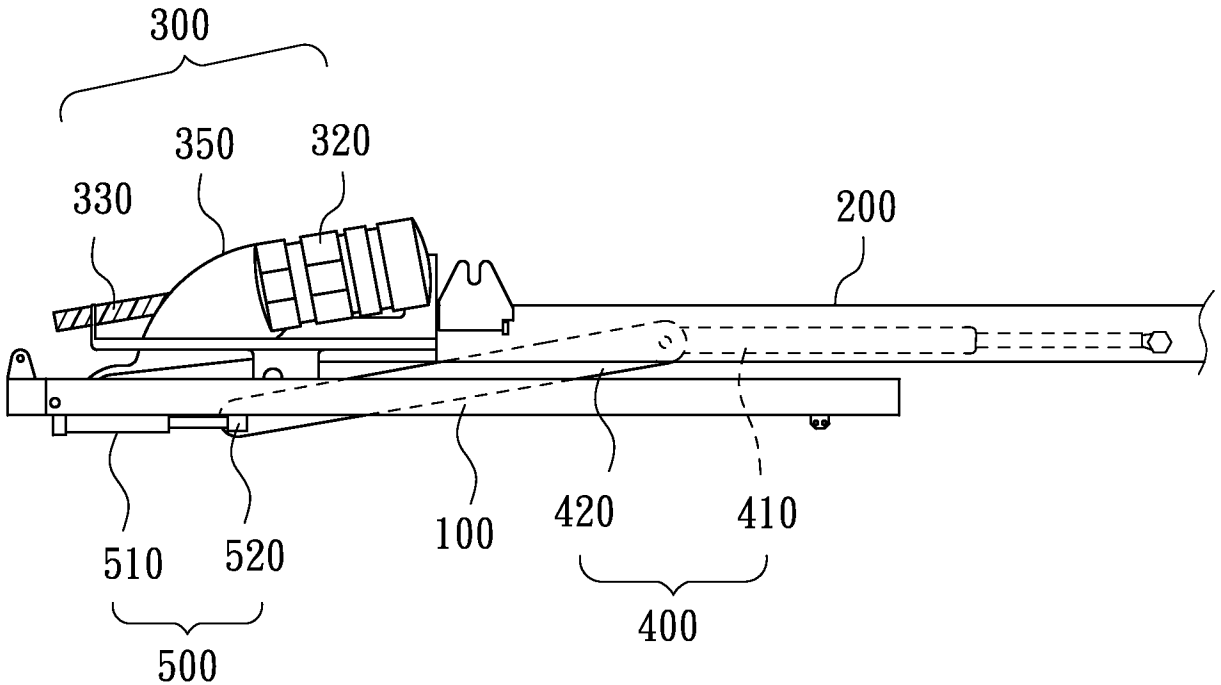
FIG. 1 is a schematic sectional side view of a folding treadmill in accordance with the present disclosure.

Referring to FIG. 1, a folding treadmill in accordance with the present disclosure is shown having a base frame 100, a running platform 200, a lifting mechanism 300, at least one folding mechanism 400, and a damping device 500. The running platform 200 has a first end thereof pivotally connected to the base frame 100. The lifting mechanism 300 is mounted between the base frame 100 and the first end of the running platform 200 for lifting the associated first end of the running platform 200. The folding mechanism 400 includes a lift cylinder 410 and a link 420. The lift cylinder 410 is installed in or on the running platform 200. The link 420 has one end thereof pivotally connected to the lift cylinder 410, and another opposed end thereof pivotally connected to the base frame 100, in particular to the damping device 500, which is connected to the base frame 100.

More particularly, the damping device 500 has a damping cylinder 510 and a slide 520. The damping cylinder 510 is mounted to or installed within the base frame 100. The slide 520 has one end thereof connected to the damping cylinder 510, and another opposed end thereof pivotally connected with the link 420 for allowing relative movement of the link 420 between the damping cylinder 510 and the lift cylinder 410. Further, the slide 520 is movable along the base frame 100.

Figure 2A:
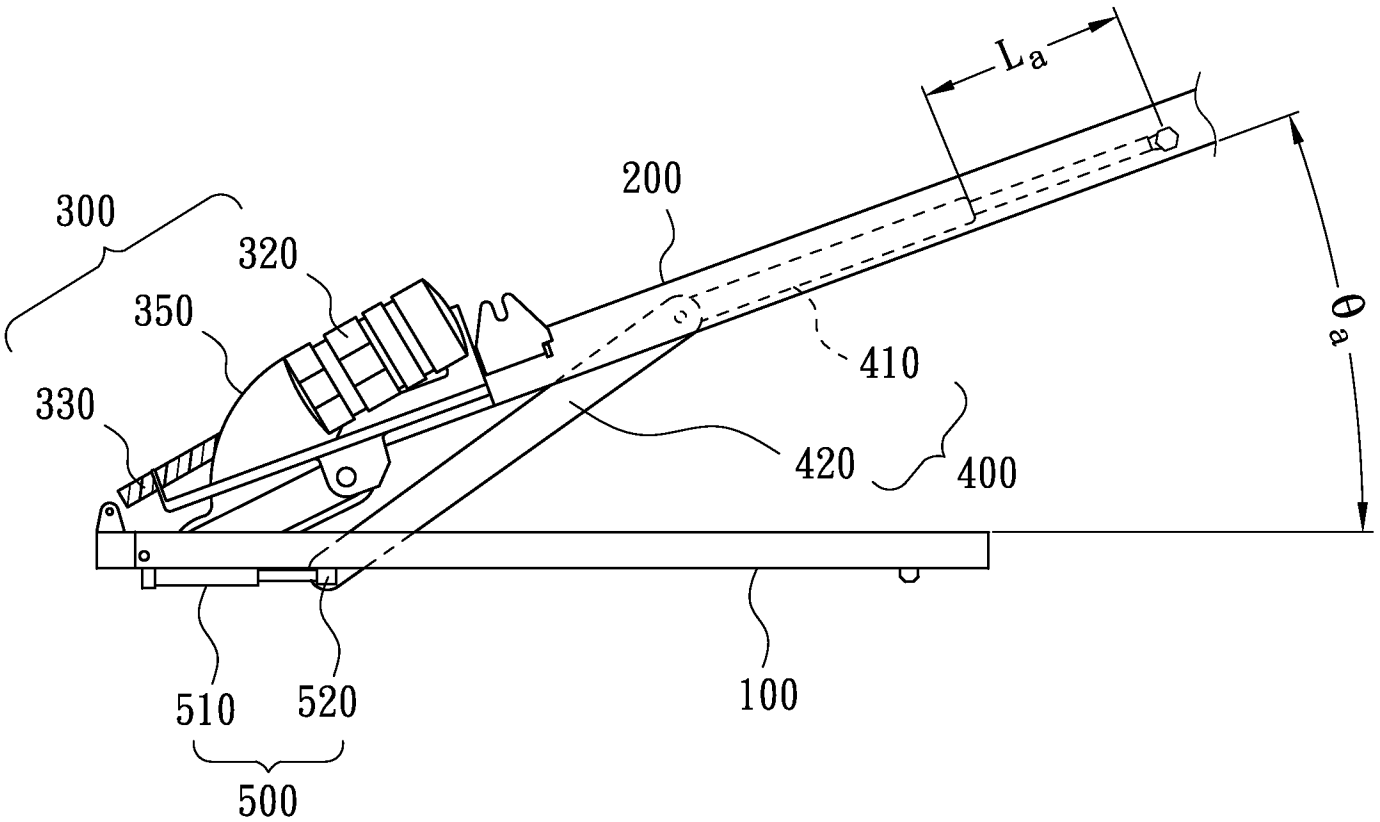
FIG. 2A is a schematic drawing illustrating a folding action of the folding operation of the folding treadmill shown in FIG. 1.
Figure 2B:
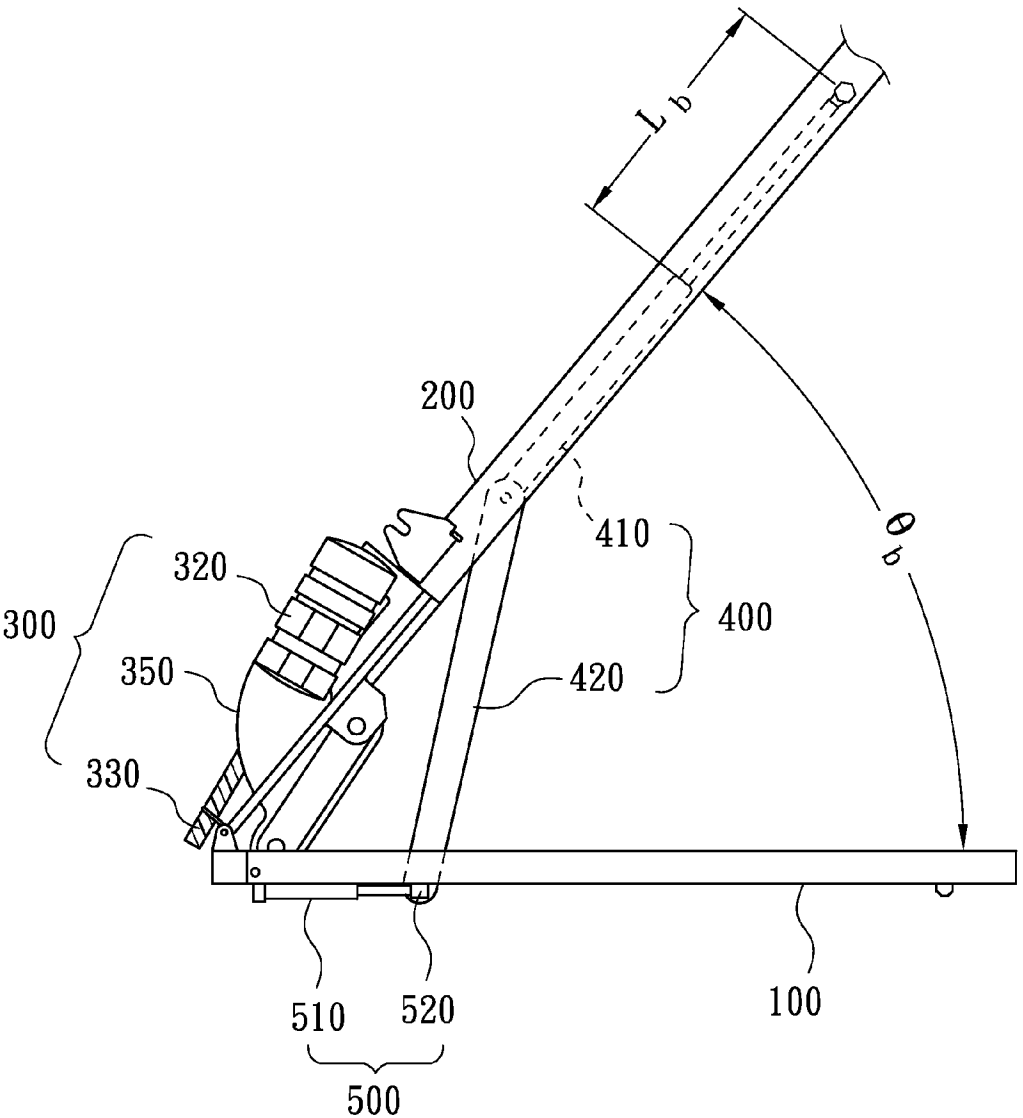
FIG. 2B is a schematic drawing illustrating another folding action of the folding operation of the folding treadmill shown in FIG. 1.

Referring to FIG. 1 and to FIGS. 2A and 2B, in this embodiment, two folding mechanisms 400 are provided, and the two folding mechanisms 400 are respectively pivotally connected between two opposite lateral sides of the base frame 100 and the two opposite lateral sides of the running platform 200 for enabling the user to fold the running platform 200 between a use position and a storage position.

When comparing FIG. 2A and FIG. 2B, it is understood that the link 420 will pull the lift cylinder 410 to a relatively greater extent when the lift angle of the running platform 200 is relatively increased, i.e., when angle $\theta_a<\theta_b$, then distance $L_a<L_b$. However, folding the running platform 200 does not affect the extending and retracting operations of the damping cylinder 510 of the damping device 500.

Figure 3:
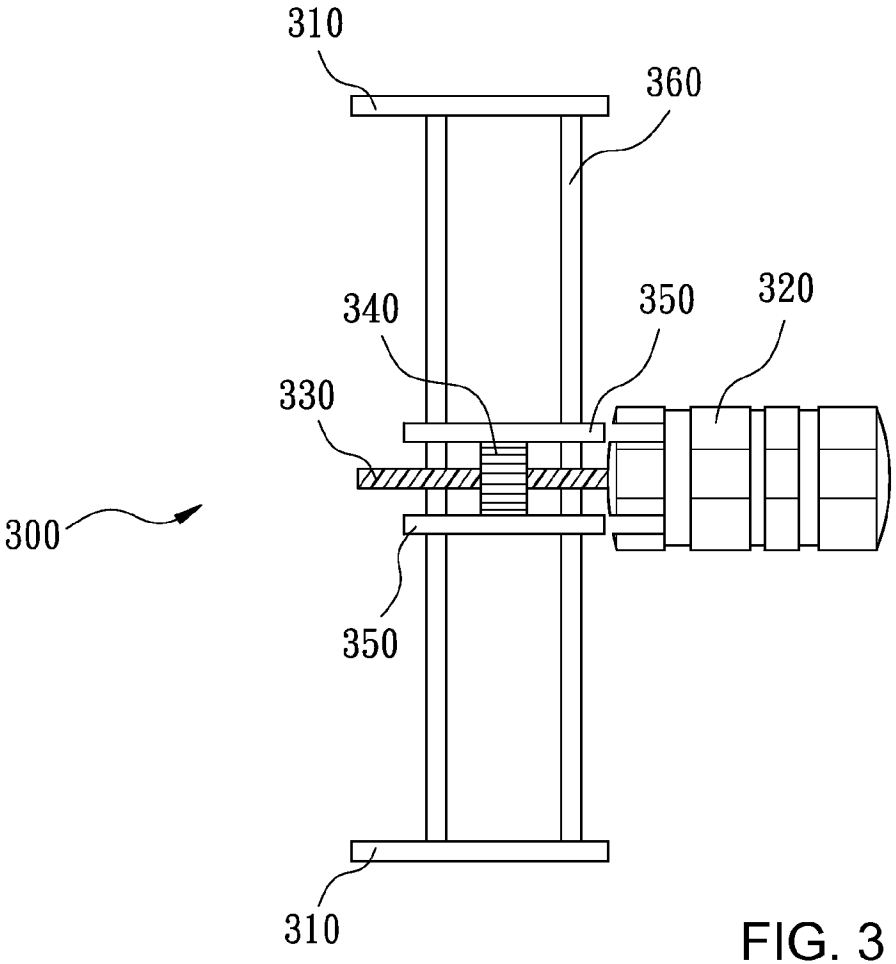
FIG. 3 is a top view of the lifting mechanism of the folding treadmill shown in FIG. 1.

Referring to FIGS. 1 and 3, to enhance the hill-climb simulation of the folding treadmill, the lifting mechanism 300 is adapted for lifting the first end of the running platform 200 to hold the running platform 200 in a tilted position. The lifting mechanism 300 includes at least one pivot rod 310, a motor 320, a screw rod 330, a screw nut 340, and at least one follower member 350.

The at least one pivot rod 310 has one end thereof pivotally connected to the first end of the running platform 200, and another opposed end thereof pivotally connected to the base frame 100. The motor 320 is mounted to the running platform 200. The screw rod 330 is connected to one end of the motor 320 and is rotatable by the motor 320. The screw nut 340 is threaded onto the screw rod 330 and is movable subject to rotation of the screw rod 330. The at least one follower member 350 has one end thereof connected to the screw nut 340, and another opposed end thereof connected to the at least one pivot rod 310.

According to this embodiment, there are two pivot rods 310, and the two pivot rods 310 are respectively pivotally connected between the two opposite lateral sides of the base frame 100 and the two opposite lateral sides of the running platform 200. The lifting mechanism 300 further includes two transverse rods 360 adapted for connecting the two pivot rods 310 and also for carrying the at least one follower member 350. Therefore, the two pivot rods 310 that are respectively pivotally connected between the two opposite lateral sides of the base frame 100 and the two opposite lateral sides of the running platform 200 are movable by the transverse rods 360 and the at least one follower member 350.

Figure 4A:
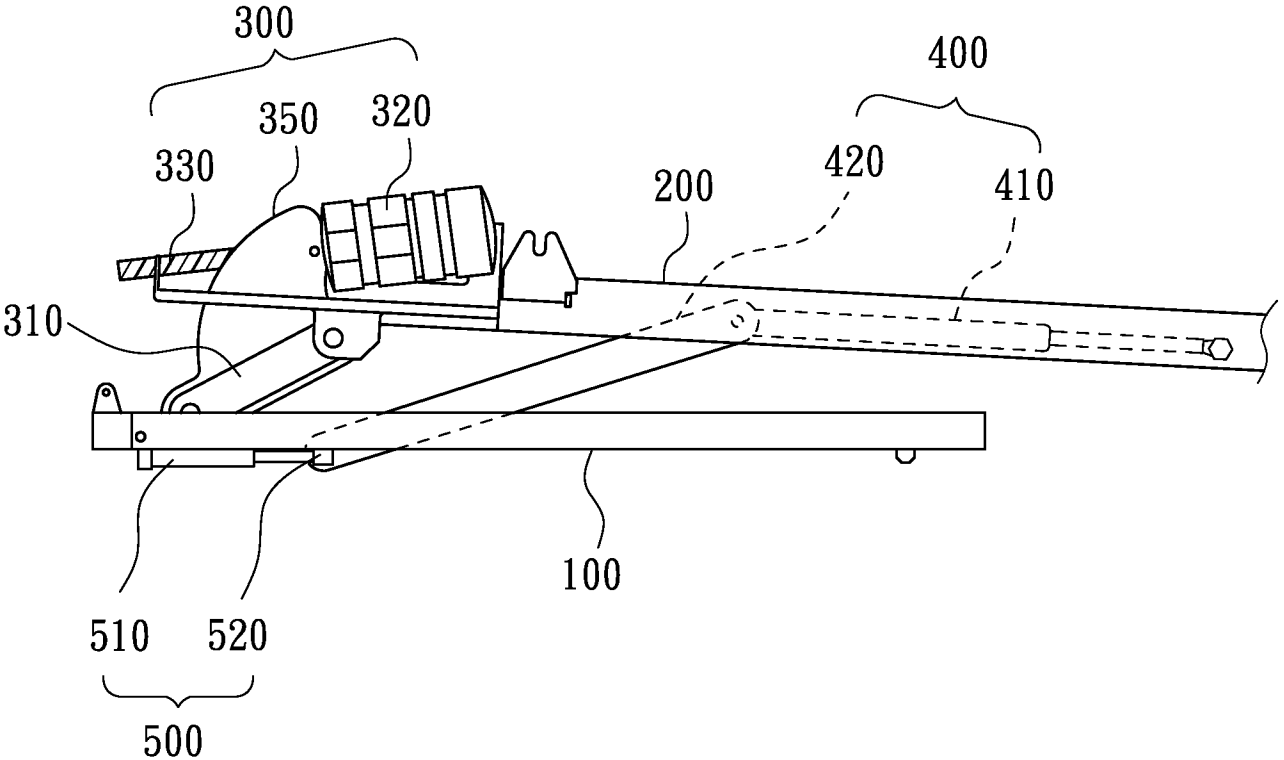
FIG. 4A is a schematic drawing illustrating a lifting action of the running platform of the folding treadmill shown in FIG. 1.
Figure 4B:
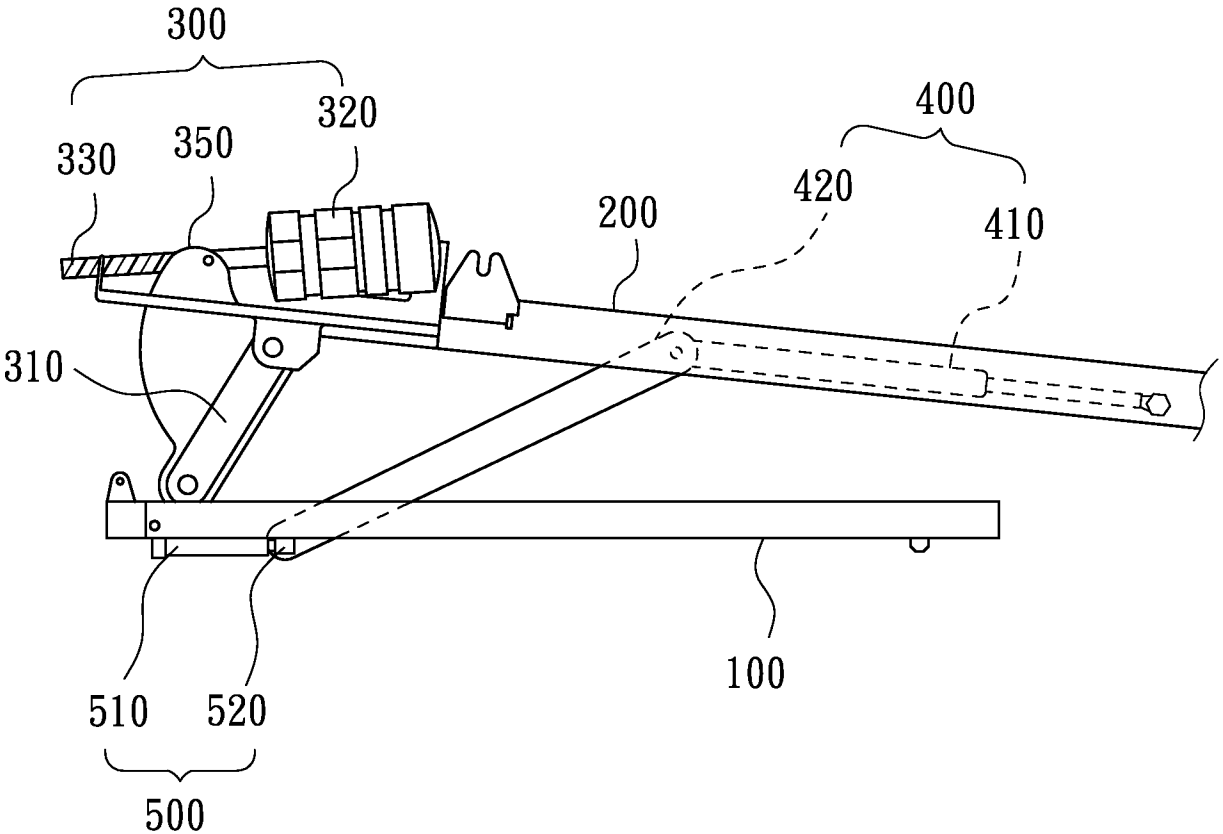
FIG. 4B is a schematic drawing illustrating another lifting action of the running platform of the folding treadmill shown in FIG. 1.

FIGS. 4A and 4B illustrate lifting actions of the running platform 200 of the folding treadmill shown in FIG. 1. As illustrated in FIG. 4A, when the motor 320 is started to rotate the screw rod 330, the screw nut 340 is forced to rotate in a direction away from the motor 320. According to this embodiment, the screw nut 340 is a ball nut. Therefore, the at least one follower member 350 will be moved with the screw nut 340 along the screw rod 330 and will not be rotated with the screw nut 340. According to this embodiment, two follower members 350 are provided, and the two follower members 350 are fastened to the screw nut 340 at two opposed sides thereof, thus enhancing the stability of the movement of the transverse rods 360 and the pivot rods 310.

When the pivot rods 310 are moved with the follower members 350 to lift the first end of the running platform 200, the links 420 of the two folding mechanisms 400 are turned upwards subject to lifting of the associated first end of the running platform 200, thereby compressing the associated lift cylinders 410.

Figure 5:
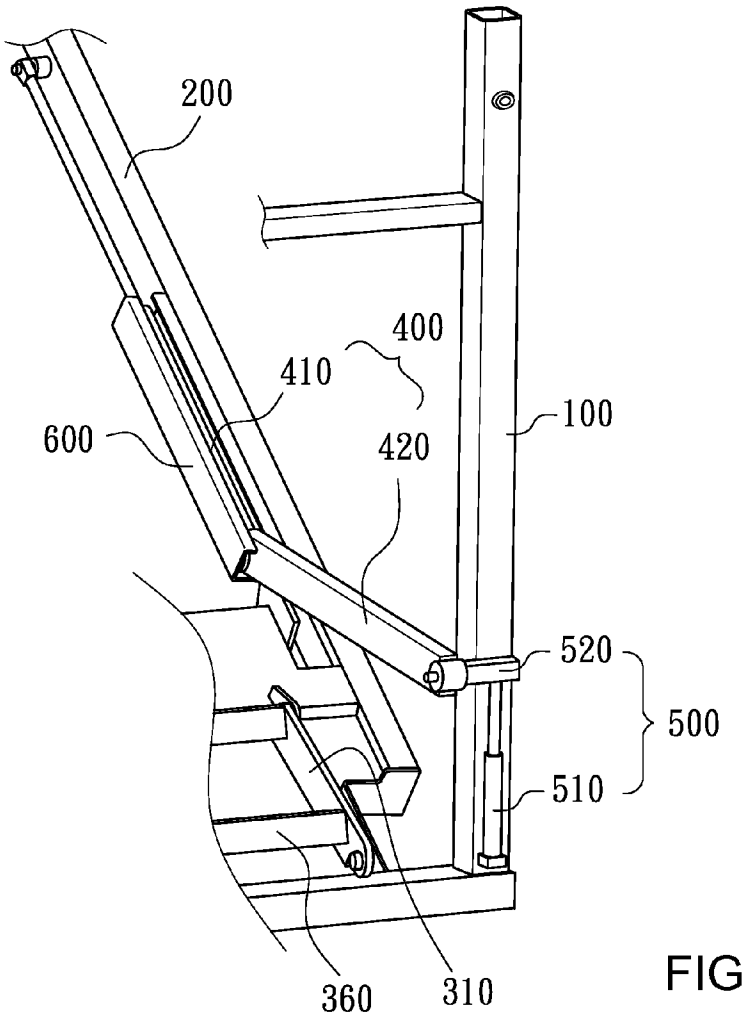
FIG. 5 is a partial bottom view of the folding treadmill shown in FIG. 1.

Referring to FIGS. 4B and 5, during lifting of the running platform 200, the lift cylinders 410 of the two folding mechanisms 400 slide within slide guide rails 600 and are compressed. When the lift cylinders 410 of the two folding mechanisms 400 reach the extent of their compression, they will not be compressed further. At this time, the links 420 of the two folding mechanisms 400 will be rotated to cause the associated first end of the running platform 200 to be continuously lifted. At this time, the slide 520 that is arranged on the two opposite lateral sides of the base frame 100 and that is pivotally connected with the links 420 of the folding mechanisms 400 will be moved to compress the damping cylinder 510 by way of the movement of the links 420.

Because the damping cylinder 510 is compressed by the horizontal thrust force of the slide 520 to absorb the horizontal component of force when the pivot rods 310 lift the associated first end of the running platform 200, the damping device 500 buffers the horizontal pressure of the movement of the screw nut 340 in carrying the follower members 350. Therefore, the damping cylinder 510 can partially absorb the horizontal load of the motor 320, avoiding an overload of the motor 320 and enhancing the lifting stability of the running platform 200.

Figure 6:
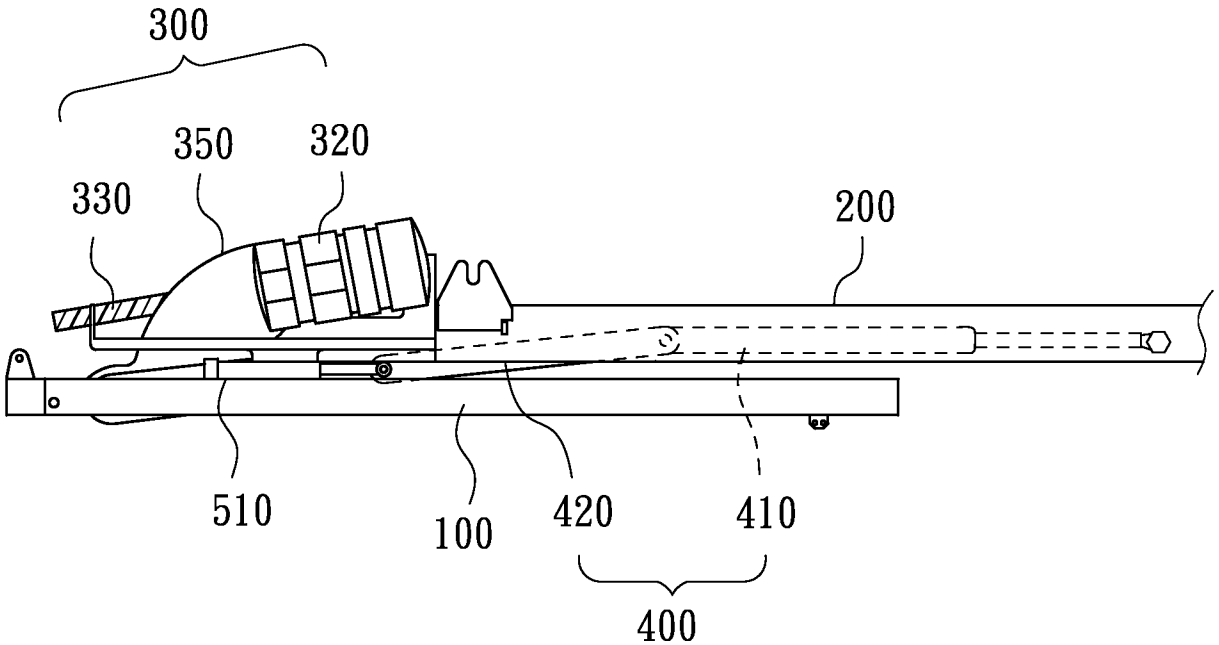
FIG. 6 is a schematic side view of an alternative form of a folding treadmill in accordance with the present disclosure.

FIG. 6 illustrates an alternative form of a folding treadmill in accordance with the present disclosure. According to this alternative form, the link 420 of the folding mechanism 400 is directly connected with the damping cylinder 510 of the damping device 500, without the use of the slide 520, so that the link 420 can directly extend or compress the damping cylinder 510.

In conclusion, the lifting mechanism 300 is operable to lift the associated first end of the running platform 200 for enabling the user to simulate running on a hill. Further, by use of the damping device 500, the horizontal component of the pressure received by the related components during lifting of the running platform 200 by the lifting mechanism 300 is buffered. Therefore, the disclosure reduces the risk of component damage of the folding treadmill, and prolongs component lifespan.

Although particular embodiments of the disclosure have been described in detail for purposes of illustration, various modifications and enhancements may be made without departing from the spirit and scope of the disclosure. Accordingly, the disclosure is not to be limited except as by the appended claims.

What is claimed is:

1. A folding treadmill, comprising:

a base frame;

a running platform having a first end thereof pivotally connected to said base frame;

a lifting mechanism mounted at one end of said base frame and to the first end of said running platform and adapted for lifting the associated first end of said running platform relative to said base frame;

at least one damping device connected to the base frame; and at least one folding mechanism, including a lift cylinder installed in said running platform and a link having one end thereof pivotally connected to said lift cylinder and an opposite end thereof pivotally connected to said at least one damping device.

2. The folding treadmill according to claim 1, wherein each damping device comprises a damping cylinder installed within said base frame, and a slide having one end thereof connected to said damping cylinder and an opposite end thereof pivotally connected to said link for allowing relative movement of said link between said damping cylinder and said lift cylinder, said slide being movable along said base frame.

3. The folding treadmill according to claim 2, wherein said damping cylinder of each damping mechanism is a pneumatic cylinder.

4. The folding treadmill according to claim 1, wherein said lifting mechanism comprises:

at least one pivot rod each having one end thereof pivotally connected to the first end of said running platform and an opposite end thereof pivotally connected to said base frame;

a motor installed in said running platform;

a screw rod connected to one end of said motor and rotatable by said motor;

a screw nut threaded onto said screw rod and movable along said screw rod upon rotation of said screw rod; and at least one follower member having one end thereof connected to said screw nut and an opposite end thereof connected to said pivot rod.

5. The folding treadmill according to claim 4, comprising two pivot rods respectively pivotally connected between two opposite lateral sides of said base frame and two opposite lateral sides of said running platform.

6. The folding treadmill according to claim 5, wherein said lifting mechanism comprises at least one transverse rod adapted for connecting said two pivot rods and for moving said at least one follower member.

7. The folding treadmill according to claim 4, comprising two follower members respectively fastened to two opposite lateral sides of said screw nut.

8. The folding treadmill according to claim 1, comprising two folding mechanisms respectively pivotally connected between two opposite lateral sides of said base frame and two opposite lateral sides of said running platform.

9. The folding treadmill according to claim 8, comprising two damping devices respectively mounted on said base frame at two opposite lateral sides thereof and movable by said two folding mechanisms.

10. The folding treadmill according to claim 1, wherein the lift cylinder of each said folding mechanism is a pneumatic cylinder.

* * * * *